United States Patent [19]

Skubon et al.

[11] 4,096,293

[45] Jun. 20, 1978

[54] MOLD AND CORE WASH

[75] Inventors: Michael J. Skubon, Columbus; John J. Spiwak, Worthington; Richard F. Hanesworth, Delaware, all of Ohio

[73] Assignee: Ashland Oil, Inc., Ashland, Ky.

[21] Appl. No.: 830,725

[22] Filed: Sep. 6, 1977

[51] Int. Cl.[2] ..... E04H 7/16; B28B 7/36

[52] U.S. Cl. ..... 427/134; 260/26; 106/38.25; 427/133

[58] Field of Search ..... 106/38.25, 38.22, 38.27; 260/26; 427/133, 134

[56] References Cited

U.S. PATENT DOCUMENTS 2,534,743 12/1950 Vincent ..... 260/26

*Primary Examiner*—Ronald H. Smith
*Assistant Examiner*—Sam Silverberg
*Attorney, Agent, or Firm*—Van D. Harrison, Jr.

[57] ABSTRACT

Disclosed is a foundry core wash made of a hydrocarbon solvent, fumaric acid resin, particulated calcium aluminate and a suspending agent. The core wash has particular utility for sand cores made with an inorganic binder used in pressurized die casting.

10 Claims, No Drawings

MOLD AND CORE WASH

NATURE OF INVENTION

This invention relates generally to foundry cores and molds. More specifically, it is concerned with a novel wash which can be applied to mold and core surfaces.

PRIOR ART

The term "core wash" is generally used in the foundry industry to denote refractory materials applied in a liquid carrier to shaped bonded aggregates, such as sand cores and molds. The primary functions of a core wash are to improve the surfaces of castings made from the molds and cores treated with a wash, and to reduce the cost of cleaning castings. Secondarily, a core wash functions to harden the surface of the shaped bonded aggregate thereby protecting the surface from metal erosion during the metal casting process.

The components of most core washes will include a refractory, a liquid vehicle, a suspending agent and a binder. In addition, other materials such as fungicides, wetting agents, defoaming agents and odor masking and scenting agents may be included.

The refractory material can be graphite, coke, mica, silica, aluminum oxide, magnesium oxide, talc, zircon flour and mixtures of these materials. The vehicle ordinarily is either water or organic solvent. The suspending agent is determined in part by the liquid vehicle used, but can consist of clay or a vegetable gum. The binder serves to bond the refractory particles together after the vehicle has been removed from the core surface by baking, ignition, or air drying. The type of binder used in also determined in part by the vehicle used. If the vehicle is water, high molecular weight carbohydrates, salts of high molecular weight organic resin salts and high molecular weight polymers are used.

In the last few years, new organic and inorganic binder formulations for bonding foundry sands into cores and molds have been developed. Cores and molds made with some of these new sand binders, however, have tended to deteriorate under the effect of moisture absorbed upon prolonged exposure to the atmosphere. This deterioration is manifested by a progressive decline in core tensile strength during storage. In order to reduce moisture absorption, solutions of resins in volatile solvents have been applied to core and mold surfaces but such solutions have not been a complete answer to the problem.

The problem of core degradation resulting from exposure to moisture becomes even more obvious when cores are utilized in casting operations conducted under pressure.

OBJECT OF THE INVENTION

An object of this invention is to provide a core wash that is compatible with both organic and inorganic core binders sensitive to water vapor.

Another object of this invention is to render shaped bonded aggregates, such as foundry cores and molds, insensitive to atmospheric moisture by covering the surface of the core with a moisture-impenetrable film.

Still another object of this invention is to provide a core wash which enhances the performance under pressurized casting operations of cores bonded either with organic or inorganic binders.

SUMMARY OF THE INVENTION

Briefly stated, our invention in one aspect, constitutes a core wash composition comprising:

1. an organic liquid in an amount of approximately 5 to 90% by weight of composition;
2. a suspending agent in an amount of 0.1 to 2% by weight of composition;
3. a wetting agent in an amount of between 0.01 and 2% by weight of composition;
4. calcium aluminate in an amount of between 5 and 80% (preferably between 30 and 50%) by weight of composition;
5. a hard resin of the fumaric acid type, in an amount of between 0.5 and 5% (preferably between 1 and 3%) by weight of composition.

In a second aspect, our invention comprises a method of treating a foundry core or mole by coating the surface of the sand core or mold with a wash of the foregoing composition.

DETAILED DESCRIPTION OF THE INVENTION

As stated above, in one aspect our invention comprises a core and mold wash whose primary components are an organic liquid, a suspending agent, a wetting agent, calcium aluminate and a hard resin of the fumaric acid type. The core wash composition can also include such secondary components as fungicides, wetting agents, defoaming agents and odor masking and scenting agents.

Selection of the liquid organic vehicle is based on the type of binder used to bind the foundry cores. If the binder is of the inorganic type, such as the boronated aluminum phosphate binder composition disclosed in U.S. Pat. Nos. 3,930,872 and 3,923,525, it is preferred to avoid polar organic solvents. Preferred solvent carriers are chlorinated hydrocarbons such as 1,1,1-trichloroethane, methylene chloride, or blends of these. If the core resin binder is of the organic type such as the binder disclosed in U.S. Pat. Nos. 3,485,797; 3,409,579 and 3,676,392 covering benzylic ether resin type compositions, the above listed organic liquids as well as polar solvents such as alcohols and ketones may also be used.

As to the suspending agent, any of the commercially available suspending agents can be used such as high molecular weight polymers, polyacrylates, colloidal silicas, clay, vegetable gums, or amine-treated bentonite.

The wetting agent can be any of the commercially available agents. We prefer methyl alcohol, water and various anionic and cationic surfactants.

The calcium aluminate which is a novel component of this core wash composition, for example under the tradename of Refcon, is available from Universal Atlas Cement, a division of United States Steel Company. The calcium aluminate preferably has a particle size averaging 20 to 25 microns with no particles larger than 70 microns. It has the chemical formula, $CaO.XA1_2O_3$. A typical analysis by weight is:

| | | |
|---|---|---|
| $Al_2O_3+TiO_2$ | 54.41 | percent |
| CaO | 37.65 | " |
| $SiO_2$ | 5.82 | " |
| $Fe_2O_3$ | 1.76 | " |
| MgO | 0.11 | " |

-continued

| | |
|---|---|
| $SO_3$ | 0.25 " |

The hard fumaric acid resin component is available commercially under various tradenames such as ARO CHEM 533, marketed by Ashland Chemical Company. These resins are best described as the reaction product of fumaric acid, gum rosin, and pentaerythritol.

EXAMPLE

A core wash was prepared by mixing the following components in the proportions shown:

| | Parts by Wt. | Percent |
|---|---|---|
| Trichloroethane | 15,000 | 50.6 |
| Fumaric Acid Resin (Tradename ARO CHEM 533) | 401 | 1.4 |
| Calcium Aluminate (Tradename Refcon) | 13,829 | 46.6 |
| Suspending Agent Amine treated Bentonite (Tradenamed Bentone 34) | 403 | 1.4 |
| Total | 29,633 | 100.0 |

The resulting core wash composition had a gravity of 60°Baume.

The core wash was then applied to a number of cores made from a mixture of foundry sand and boronated aluminum phosphate binder and allowed to dry. The cores were then utilized in die-casting operations at casting pressures up to 1400 psi. Visual examination of the surfaces of the resulting castings indicated that the core wash coating had effectively resisted erosion and penetration by molten aluminum under the casting pressures used.

In some instances it may be desirable also to add to the composition of this invention, a small amount of paraffin wax. Generally the amount of paraffin wax should be between 0.1 and 5.0 parts per 100 parts by weight of composition.

I claim:

1. A core and mold wash comprising:

(a) an organic liquid solvent in an amount of approximately 5% to 90% by weight of composition;

(b) a suspending agent in an amount of 0.1% to 2% by weight of composition;

(c) a wetting agent in an amount of between 0.01 and 2% by weight of composition;

(d) calcium aluminate particles in an amount of between 5% and 80% by weight of composition, having an average particle size of 20 to 25 microns and no particles larger than 70 microns;

(e) a hard resin which is the reaction product of fumaric acid, gum rosin, and pentaerythritol, said resin is within the ratio by weight between about .5 and about 5 parts per 100 parts of composition.

2. The composition of claim 1 wherein said organic solvent is an aldehyde or ketone.

3. The composition of claim 1 wherein said organic solvent is selected from the group consisting of 1,1,1-trichloroethane, methylene chloride and mixtures thereof.

4. The composition of claim 1 wherein said organic solvent is 1,1,1-trichloroethane.

5. The composition of claim 1 comprising, in addition, about 0.1 to about 5.0 parts by weight of paraffin wax per 100 parts of composition.

6. A method of treating foundry sand cores or molds comprising coating the surfaces of said molds or cores with the composition of claim 1.

7. The method of treating foundry sand cores or molds comprising coating the surfaces of said molds or cores with the composition of claim 2.

8. A method of treating foundry sand cores and molds comprising coating the surfaces of said molds or cores with the composition of claim 3.

9. A method of treating foundry sand cores or molds comprising coating the surfaces of said molds or cores with the composition of claim 4.

10. A method of treating foundry sand cores or molds comprising coating the surfaces of said molds or cores with the composition of claim 5.

* * * * *